United States Patent [19]

Rydeen

[11] 4,409,763

[45] Oct. 18, 1983

[54] POST AND BEAM BUILDING

[76] Inventor: Robert J. Rydeen, Box 207, Main St., Fremont, N.H. 03044

[21] Appl. No.: 246,612

[22] Filed: Mar. 23, 1981

[51] Int. Cl.[3] ..... E04C 1/24

[52] U.S. Cl. ..... 52/93; 52/585

[58] Field of Search ..... 403/169, 170, 171, 176; 52/283, 90–94, 723, 585, 301, 263, 648

[56] References Cited

U.S. PATENT DOCUMENTS

| | | | |
|---|---|---|---|
| 794,595 | 7/1905 | Ducker . | |
| 872,658 | 12/1907 | Lee | 52/92 |
| 1,060,853 | 5/1913 | Peirce | 52/283 |
| 1,152,655 | 9/1915 | O'Hara | 52/275 |
| 1,205,465 | 11/1916 | Maguire et al. | 52/723 |
| 1,492,560 | 5/1924 | Fisher | 52/92 |
| 1,661,128 | 2/1928 | Mankedick | 52/723 |
| 1,907,119 | 5/1933 | Reynolds | 52/92 |
| 2,046,246 | 6/1936 | Clem | 52/780 |
| 2,183,620 | 12/1939 | Myers | 20/5 |
| 2,362,162 | 11/1944 | Sheldon | 20/2 |
| 2,569,107 | 9/1951 | Johnson | 46/19 |
| 2,932,477 | 4/1960 | Franks | 248/120 |
| 3,065,506 | 11/1962 | Tremer | 52/263 |
| 3,222,030 | 12/1965 | Thorpe | 52/126.6 |
| 3,350,824 | 11/1967 | Wiebusch | 52/241 |
| 3,465,487 | 9/1969 | Fatosme et al. | 52/241 |
| 3,821,868 | 7/1974 | Edwards | 52/241 |
| 3,995,402 | 12/1976 | Parenteau | 52/241 |
| 4,079,995 | 3/1978 | Beckley | 297/440 |

FOREIGN PATENT DOCUMENTS

| | | | |
|---|---|---|---|
| 89780 | 9/1921 | Switzerland | 52/275 |
| 101950 | 10/1923 | Switzerland | 52/483 |
| 18093 | of 1913 | United Kingdom | 52/90 |

OTHER PUBLICATIONS

T. Benson & J. Gruber, *Building the Timber Frame House: The Revival of a Forgotten Craft,* Charles Scribner's Sons, 1980.

*Primary Examiner*—James L. Ridgill, Jr.
*Attorney, Agent, or Firm*—Charles E. Bruzga

[57] ABSTRACT

An improved post and beam building incorporates a novel joint between a post and a plurality of beams, which joint utilizes a vertically oriented dowel to align and hold the post and beams together. The improved building further incorporates exterior walls which provide structural support for the post and beams, and also incorporates interior walls which are easily installed.

17 Claims, 10 Drawing Figures

POST AND BEAM BUILDING

BACKGROUND OF THE INVENTION

The present invention relates to post and beam buildings, and more particularly to such buildings having a novel connection or joint between a post and a plurality of beams joined thereto, and having exterior and interior walls which cooperate with posts and beams to obtain unique advantages.

Post and beam buildings utilize a framework comprising upright posts and horizontal beams joined to the posts. To this framework there are added exterior and interior walls for a typical dwelling structure, or only exterior walls for a typical barn structure. The posts and beams typically comprise timber. Post and beam buildings have been built for the past several centuries. During this period of time, the following features of post and beam buildings have remained substantially unchanged. First, the joint between a post and the beams connected thereto has utilized reinforcing braces. These braces are typically short lengths of timber diagonally oriented with respect to the post and beams and connected at one end to the post and at the other end to one of the beams. The foregoing feature has the disadvantage of resulting in the need for a large number of basic building elements for a post and beam building. In general the number of basic building elements required for a building, the higher the cost for the building elements. Additionally, even where the post, beams, and reinforcing braces are manufactured or precut to reasonably close tolerances, there still exists the further disadvantage of the need for a skilled artisan to align the various parts vis-a-vis each other and vis-a-vis the desired orientation of the overall building. Second, exterior walls and interior walls (for example, for a dwelling structure) have been added to a completed framework of posts and beams to provide exterior and interior walls only as an incidental feature. A disadvantage of the foregoing is that exterior and interior walls do not otherwise cooperate with the post and beam framework in significant ways, thereby underutilizing the capabilities of these building elements.

OBJECTS OF THE INVENTION

Summary of the Invention

Accordingly, it is an object of the present invention to provide an improved post and beam building requiring a lesser number of basic building elements than the prior art post and beam building.

It is a further object of this invention to provide an improved post and beam building not requiring a skilled artisan to align the post and beams thereof.

It is yet a further object of this invention to provide an improved post and beam building wherein exterior and interior walls thereof cooperate in significant ways with the posts and beams thereof, whereby various advantages as set forth below are attained.

Further objects and advantages of the present invention will become apparent from a reading of the remainder of this specification in conjunction with the drawing figures.

BRIEF DESCRIPTION OF THE DRAWING FIGURES

In the drawing figures, in which the various parts are typically proportioned with respect to each other:

In carrying out the present invention, there is a provided an improved post and beam building comprising a post, first and second beams parallel to an exterior wall of the building, and a third beam orthogonal to the first and second beams. Each beam has a longitudinal section resting on the post and has a cross section substantially undiminished from the cross section of the main portion of the respective beam. Each beam has a further longitudinal section, with such section of the first beam resting on the post, such section of the third beam resting on such section of the first beam, and such section of the third beam resting on such section of the second beam. The joint includes a dowel which is inserted into aligned, vertical apertures of the post and the first, second, and third beams.

In a form of the invention providing exterior walls for the improved post and beam building, there is further included a second post adjacent to the first post and supporting the first beam, a sill upon which these posts rest, and an exterior wall panel. The adjacent, exterior edges of these adjacent posts, the first beam, and the sill have two-sided cutouts therein, these cutouts, rigidly receiving the peripheral portions of the exterior wall panel.

In a form of the invention providing interior walls for the improved post and beam building, there is further included an interior wall panel. The interior, adjacent edges of the adjacent posts, the first beam, and the sill have recesses therein, these recesses receiving the peripheral portions of the interior wall panel. The foregoing recesses comprise one of the group consisting of two-sided cutouts and grooves.

DETAILED DESCRIPTION

Figure 1:
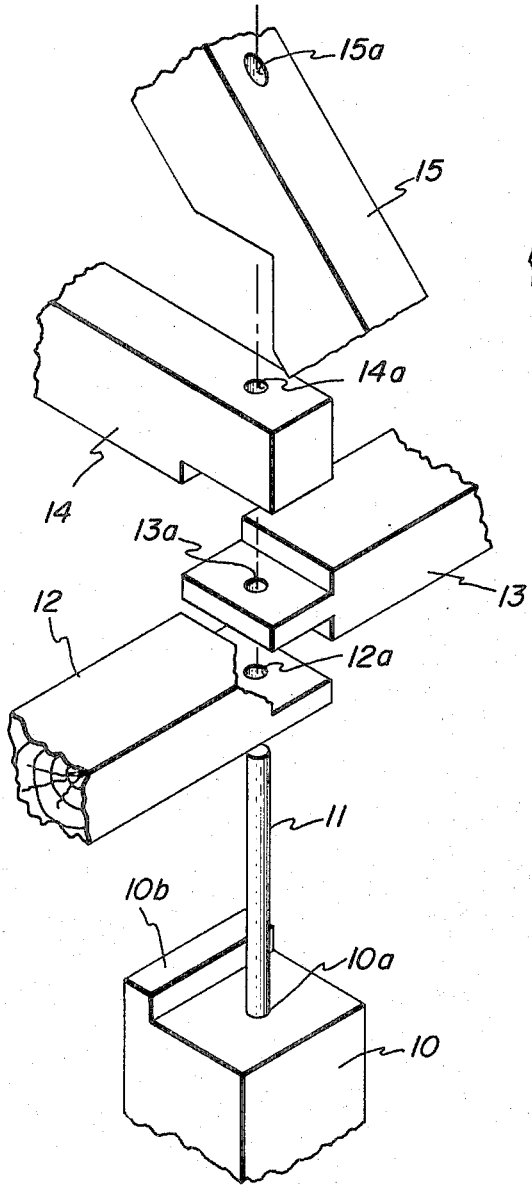
FIG. 1 is an exploded view in perspective from the exterior of a post and beam building of a novel joint between a post and beams (and a rafter) in accordance with the present invention.

There is shown in FIG. 1 an exploded view of a joint between a post 10, beams 12, 13 and 14 and a rafter 15, in accordance with the present invention. The foregoing parts are suitably comprised of timber. A dowel 11 extends upward from a vertical aperture 10*a* in the post 10, and is designed to extend through aligned, vertical apertures 12*a*, 13*a*, 14*a*, and 15*a*, respectively of the beams 12, 13 and 14, and the rafter 15. The dowel 11 aligns and holds the posts 12–15 together. The dowel 11 is suitably comprised of $1\frac{1}{4}$ inch oak timber although other materials such as fiberglass or steel can be used therefor. The aperature 10*a* has a deep enough depth to rigidly secure the dowel 11 when the dowel is fully inserted into it. Such depth suitably would be approximately 8 inches where the post 10 has typical width and thickness dimensions of about 8 by 8 inches. The post 10 has an upward projection 10*b* at the upper surface thereof, the purpose of which will be discussed below.

Figure 2:
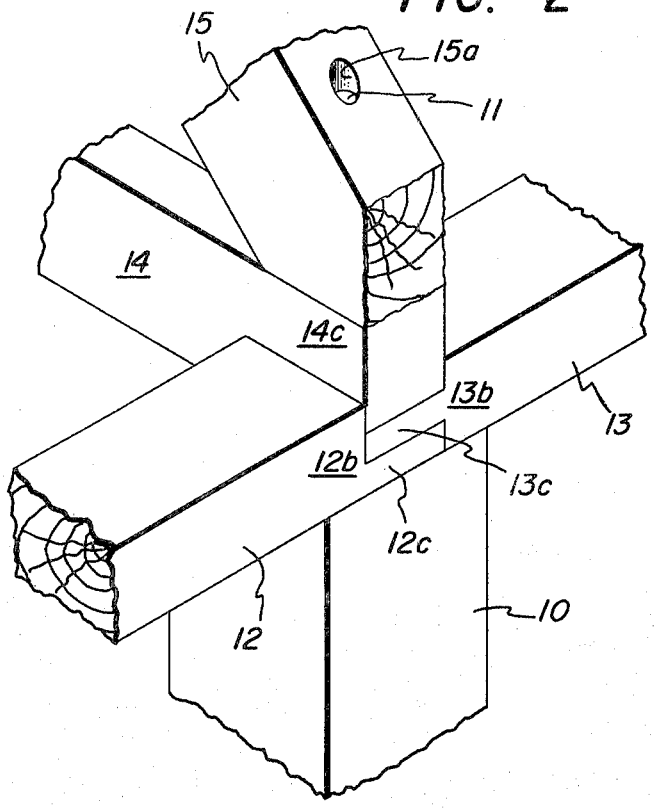
FIG. 2 is an assembled view of the joint of FIG. 1 with part of the rafter removed.

Turning to FIG. 2, the joint of FIG. 1 is shown in assembled form. It can be seen that the beams 12 and 13 respectively have longitudinal section 12*b* and 13*b* resting on the post 10. These sections 12*b* and 13*b* each have a cross section substantially undiminished from the cross section of the main portion of the respective beam 12 or 13. Due to this fact, the carrying strengths of the beams 12 and 13 are fully utilized. Additionally, the beams 12 and 13 are protected against splitting near the points where they rest on the post 10.

Figure 3:
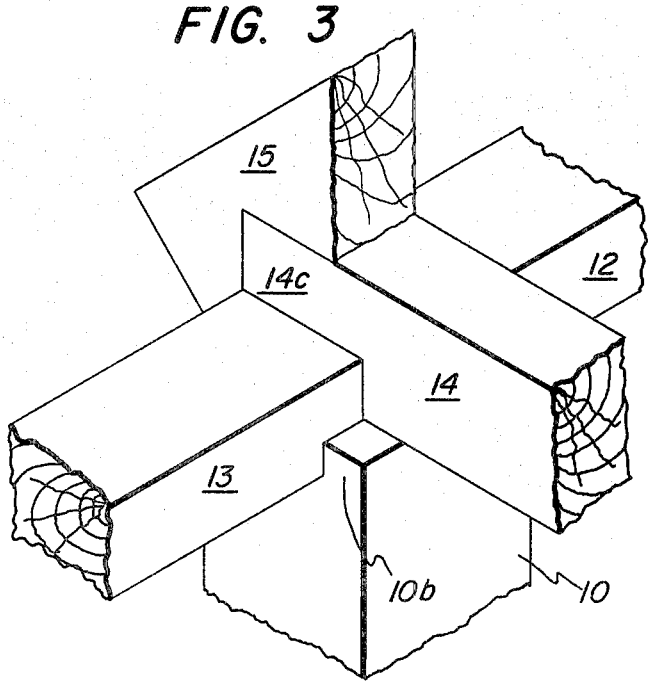
FIG. 3 is a perspective view of the joint of FIG. 1 from the interior of the post and beam building with part of the rafter removed.

Referring to FIG. 3, it can be seen that the beam 14 has a longitudinal section 14*b* resting on the post 10 and having a substantially undiminished cross section relative to the cross section of the main portion of the beam 14. Due to this, the carrying strength of the beam 14 is fully utilized. This is especially important where the beam 14 spans a considerable weight. Additionally, the beam 14 is protected against splitting near the point where it rests on the post 10.

Referring back to FIG. 2, the beams 12, 13 and 14 have respective further longitudinal sections 12*c* 13*c* and 14*c*. The section 12*c* rests on post 10, the section 13*c* rests on an upper surface of the section 12*c*, and the section 14*c* rests on an upper surface of the section 13*c*. It is these further longitudinal sections 12*c*, 13*c* and 14*c* which respectively have the aligned, vertical apertures 12*a*, 13*a* and 14*a* therein (see FIG. 1), through which the dowel 11 extends. Additionally, the sides of the section 14*c* laterally abut portions of the beam 12 and the beam 13, whereby the beam 14 is maintained rigidly oriented with respect to the beams 12 and 13. With the foregoing arrangement of the sections 12*c*, 13*c* and 14*c*, the assembly of the subject joint is a simple procedure that can be performed by unskilled labor and which results in a joint that is sturdy, fully utilizes the carrying strengths of the beams 12, 13 and 14 and protects these beams from splitting near the points where they rest on the post 10.

The rafter 15 can advantageously be incorporated into the subject joint as best illustrated in FIG. 1. The vertical aperture 15*a* therein can receive the dowel 11 to further simplify the erection of a post and beam building. As viewed in FIG. 3, the lower portion of the rafter 15 laterally abuts the left end of the beam 14, thereby helping to prevent movement of the beam 14 to the left.

The purpose of the upward projection 10*b* of the post 10 is as follows. As best illustrated in FIG. 3, the beams 12 and 13 laterally abut the protrusion 10*b*. Due to this fact, the post 10 is rendered substantially fixed against rotational movement, thereby resulting in a sturdier joint. Additionally, the projection 10*b* serves the purpose of supporting section 14*b* of the beam 14.

The joint of FIGS. 1–3 is suitably used for joints in a post and beam building other than at corners thereof. Such corners included both "outside" and "inside" corners. This is simply because corner joints would not utilize both beams 12 and 13. The construction of a corner joint would be obvious to a person skilled in the art based upon the teaching of the present invention.

The joint of FIGS. 1–3 are suitably used at each non-corner joint on a post and beam building, whereby the beams 12 and 13 each span, and rest upon a pair of adjacent posts. With such an arrangement, referring to FIG. 1, it is advantageous to shape the left end of the beam 12 (not shown) the same as was as the left end of the beam 13, as illustrated. Likewise, the right end of the beam 13 (not shown) is advantageously shaped the same way as the right end of the beam 12, as illustrated. This results in the provision of a common building element which can interchangeably serve as the beam 12 or the beam 13, thereby reducing the number of basic building elements of a post and beam building and furthering the simplicity of assembling a post and beam building. It may be desirable, however, to provide beams 12 and 13 which each span, and rest upon, more than a pair of adjacent posts. The ends of each beam 12 or 13 would then suitably terminate in a joint as illustrated in FIGS. 1–3. The intermediate joint or joints where the main portion of the beam 12 or 13 rests upon a post or posts would suitably comprise a modification of the joint of FIGS. 1–3 described as follows. Referring to FIGS. 1–3, the beams 12 and 13 would form a "continuous" beam without a break between the sections 12*c* and 13*c*. (In such a case, the aligned, vertical apertures 12*a* and 13*a* would comprise a single, vertical aperture.) Even with this arrangement, it is desirable that such continuous beams 12 and 13 span, and rest upon, a standard number of posts whereby the continuous beams 12 and 13 would comprise a common building element.

The post and beams of the joint illustrated in FIGS. 1–3 are depicted as having simple rectangular cross sections in the main portions thereof. The further drawing Figures, relating to the provision of exterior and interior walls, depict posts and beams with joints according to FIGS. 1–3. The joints of the further Figures show posts and beams having cross sections which are generally rectangular but which are more complex than the cross sections of the post and beams of FIGS. 1–3.

Figure 4:
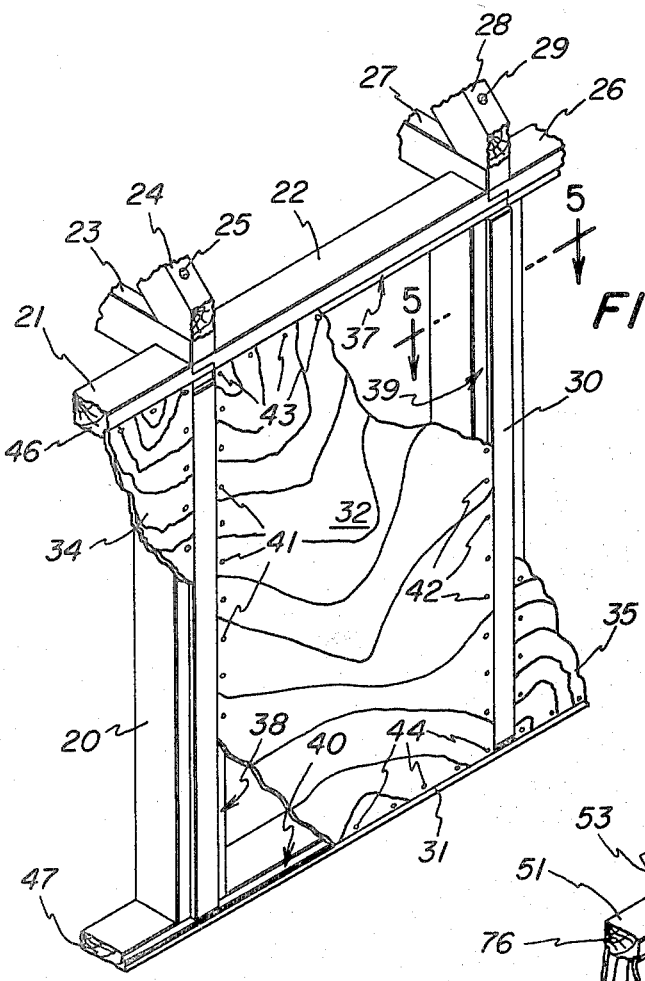
FIG. 4 is a perspective view of a fragmentary portion of a post and beam building from the exterior thereof illustrating exterior walls in accordance with the present invention.

Turning to FIG. 4, there is shown a fragmentary portion of a post and beam building from an exterior thereof illustrating exterior walls in accordance with the present invention. A joint according to the present invention is formed at the connection of a post 20, beams 21, 22 and 23, and a rafter 24. A dowel 25 serves to align and hold these parts together. A further joint according to the present invention is formed at the connection of a post 30, the beam 22 and beams 26 and 27, and a rafter 28. A dowel 29 serves to align and hold these parts together. Either of the foregoing joints can be modified as discussed above if the beam 22 comprises a "continuous" beam with either beam 21 or 26. The posts 20 and 30 rest on a sill 31. The sill 31 is shown as a unitary piece of timber for simplicity. An exterior wall panel 32 is shown and is partially broken away to facilitate understanding. In addition, portions of exterior wall panels 34 and 35 which are suitably identical to the wall panel 32, are illustrated.

Figure 5:
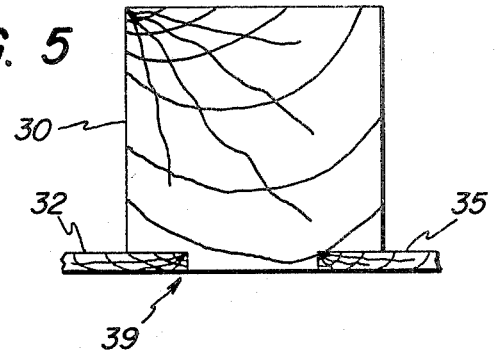
FIG. 5 is a cross-sectional view taken at arrows 5 in FIG. 4.

The exterior, adjacent edges of the beam 22, the posts 20 and 30, and the sill 31 are provided with two-sided cutouts 37, 38, 39 and 40 respectively. The two-sided cutouts 38 and 39 rigidly receive opposite side portions of the exterior wall panel 32, respectively, as with nails 41 and 42 and the two-sided cutouts 37 and 40 rigidly receive top and bottom portions of the exterior wall panel 32, respecively, as with nails 43 and 44. Details of the cutouts 37 and 40 of the beam 22 and the sill 31 will be further understood by observing the cross sections 46 and 47 of the directly analogous beam 21 and of the sill 31, respectively. Details of the cutouts 38 and 39 of the posts 20 and 30 will be further understood by observing the cross sectional view of the post 30 taken at arrows 5 and shown in FIG. 5.

The exterior wall panel 32 advantageously comprises a unitary, stiff, planar structure preferably being a single piece of plywood. Other unitary, stiff, planar structures may be used, however, such as particle board. Alternatively the wall panel 32 may comprise a plurality of component elements which collectively and preferably have structural properties similar to the structural properties of a unitary structural member. The wall panel 32 cooperates with the posts 20 and 30, the beam 22, and the sill 31 to rigidly reinforce the posts 20 and 30 and the beam 22 against relative movement to the right or to the left, as viewed in FIG. 4. This provides for a very sturdy post and beam building. The wall panel 32 further cooperates with the posts 20 and 30, the beam 22, and the sill 31 to provide a self-aligning feature when the panel 32 is disposed into the cutouts 37, 38, 39 and 40. Thus, without the necessity of a skilled artisan, the posts, beams, and exterior walls of a post and beam building can be easily erected in proper alignment. The wall panel 32 still further cooperates with the posts 20 and 30, the beam 22 and the sill 31 to provide a substantially draft-free barrier between the wall panel 32 and the foregoing parts. Such a draft free barrier is desirable to reduce heat transfer between the interior and the exterior of the building. It can thus be appreciated that the exterior walls of the present invention cooperate in significant ways with the posts and beams which are interconnected in accordance with the joints of the present invention.

Figure 6:
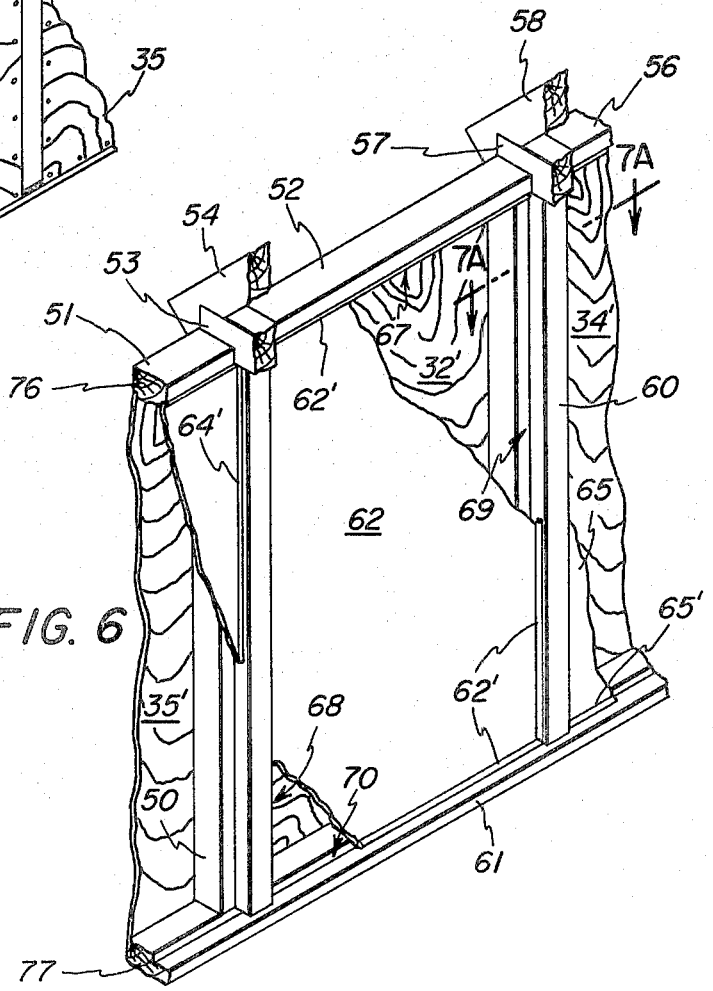
FIG. 6 is a perspective view of a fragmentary portion of a post and beam building from the interior thereof illustrating interior walls in accordance with the present invention.

Turning to FIG. 6, there is shown a fragmentary portion of a post and beam building from an interior thereof, illustrating interior walls in accordance with the present invention. A joint according to the present invention is formed at the connection of a post 50, beams 51, 52 and 53, and a rafter 54, a dowel (not shown) serving to align and hold these parts together. A further joint according to the present invention is formed at the connection of a post 60, the beam 52, beams 56 and 57, and a rafter 58, a dowel (not shown) serving to align and hold these parts together. Either of the foregoing joints can be modified as discussed above if the beam 52 comprises a "continuous" beam with either beams 51 or 56. The posts 50 and 60 rest on a sill 61. The sill 61 is shown as a unitary piece of timber for simplicity. An interior wall panel 62, partially broken away to facilitate understanding, is shown. In addition, portions of interior wall panels 64 and 65, suitably identical to the wall panel 62, are illustrated. Located behind the interior wall panels 62, 64 and 65 are exterior wall panels 32', 35', and 34', respectively, constructed in accordance with the exterior wall panels 32, 35 and 34 of FIG. 4, discussed above.

The interior, adjacent edges of the beam 52, the posts 50 and 60, and the sill 61 are respectively provided with recesses comprising two-sided cutouts 67, 68, 69 and 70. The two-sided cutouts 68 and 69 receive opposite side portions of the interior wall panel 62, respectively, and the two-sided cutouts 67 and 70 receive top and bottom portions of the interior wall panel 62, respectively. Details of cutouts 67 and 70 of the beam 62 and the sill 61 will be further understood by observing the cross sections 76 and 77 of the directly analogous beam 51 and the sill 61, respectively. Details of the two-sided cutouts 68 and 69 of the posts 50 and 60 will be further understood by observing the cross sectional view of the post 60 taken at arrows 7A and shown in FIG. 7A. Molding strips 62', 64' and 65' respectively cover the interior peripheral portions of the wall panels 62, 64 and 65 and advantageously thus "mask" nails or other fastening means for holding the panels 62. 64, and 65 in place. The molding strips 62', 64' and 65' are suitably secured in place by adhesives, nails, or other conventional means.

The interior wall panel 62 suitably comprises a wall panel of conventional construction. The wall panel 62 cooperates with the posts 50 and 60, the beam 52, and the sill 61 to provide a substantially draft-free barrier between the wall panel 62 and the foregoing posts. In this regard, it is desirable that the wall panel 62 comprise a unitary wall panel to facilitate such cooperation. Additionally, due to the intimate contact between the peripheral portions of the interior and exterior wall panels 62 and 32' and their respective two-sided cutouts, these interior and exterior wall panels 62 and 32' cooperate to provide a substantially draft-free zone there between. Such a zone is particularly advantageous in reducing heat transfer between the interior and the exterior of the post and beam building. The interior wall panel 62 further cooperates with the posts 50 and 60, the beam 52, and the sill 61 to provide an interior wall panel which can be installed easily by unskilled labor without the necessity for measuring or aligning tools. This is due to the fact that after the posts 50 and 60, the beam 52 and the sill 61 are properly positioned by the installation of the exterior wall panel 32' (as discussed above with respect to the directly analogous exterior wall panel 32), the two-sided cutouts 67, 68 69 and 70 alignedly receive the peripheral portions of the interior wall panel 62. From the foregoing, it can be appreciated that the interior walls of the present invention cooperate in significant ways with posts and beams which are interconnected in accordance with the joints of the present invention.

Figure 7A:
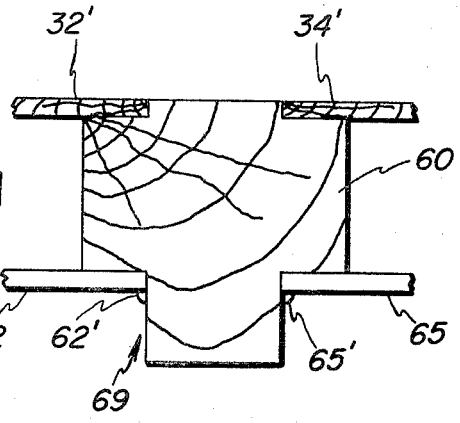
FIGS. 7A and 7B are respectively a cross-sectional view taken at arrows 7A in FIG. 6 and view similar to FIG. 7A illustrating an alternative embodiment of the present invention.
Figure 7B:
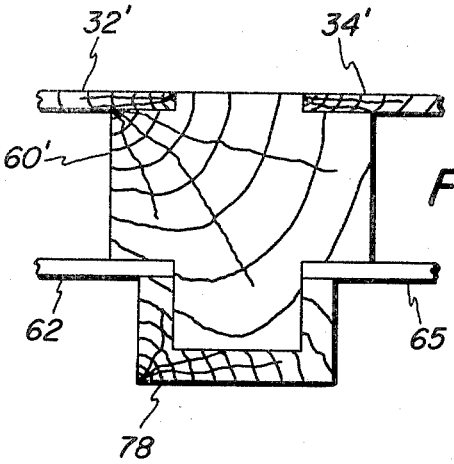

In FIG. 7B, which is similar to FIG. 7A, there is shown an alternative to the molding strips 62' and 65' which are shown in FIG. 7A. The post 60 (FIG. 7A) has been modified to become post 60' (FIG. 7B). A facade 78 is used instead of the molding strips 62' and 65' (FIG. 7A). The facade 78 has a U-shaped cross section and advantageously covers the entire vertical span of the post 60'. It is to be noted that the two-sided cutouts of the post 60' alignedly receive the adjacent side portions of the wall panels 62 and 65 in the same manner as the two-sided cutouts of the beam 60.

Figure 8:
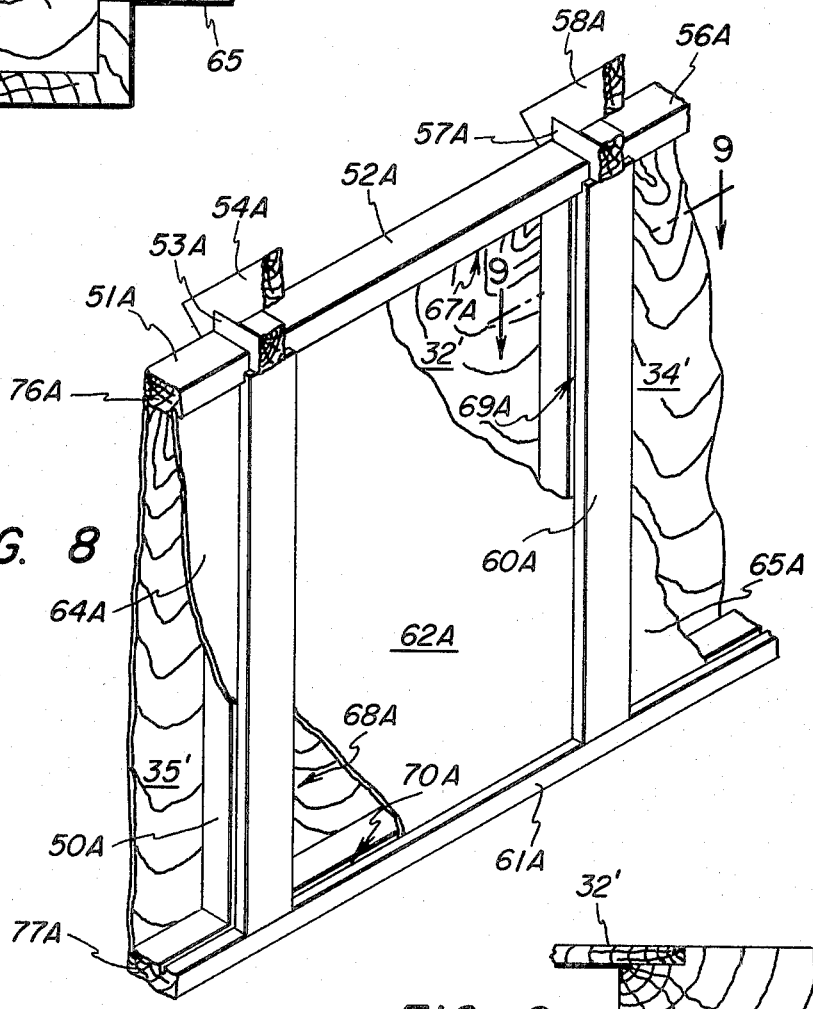
FIG. 8 is a perspective view similar to FIG. 6 illustrating an alternative arrangement of the interior walls of the present invention.
Figure 9:
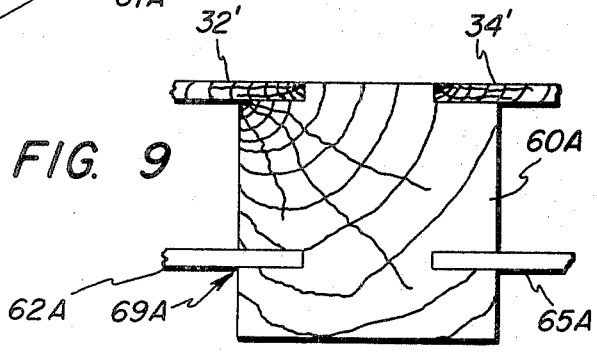
FIG. 9 is a cross-sectional view taken at arrows 9 in FIG. 8.

Turning to FIG. 8, there is shown a fragmentary portion of a post and beam building similiar to FIG. 6 and illustrating a further embodiment of interior walls according to the present invention. Various parts in FIG. 8 correspond to parts in FIG. 6 and are given the same reference numbers as the parts in FIG. 6 followed by the letter "A". The difference between the walls in FIG. 6 and the walls in FIG. 8 is that the walls in the former Figure are alignedly received into recesses comprising two-sided cutouts, whereas in the latter Figure the walls are alignedly received by recesses comprising grooves. For instance, the peripheral portions of an interior wall panel 62A are alignedly received by the grooves 67A (not visible) 68A (not visible), 69A and 70A. Further understanding of details of the grooves 67A and 70A of the beam 52A and the sill 61A can be obtained by oberving cross section 76A of the directly analogous beam 51A and cross section 77A of the sill 61A, respectively. Further understanding of details of the grooves 68A and 69A of the posts 50A and 60A can be obtained by observing the cross sectional view of the post 60A taken at arrows 9 and shown in FIG. 9.

The interior wall panel 62A of the embodiment of FIG. 8 does not have need for the molding strips or the facade used in the embodiments of FIGS. 6 and 7B, respectively, and therefore provides a post and beam building with still fewer component parts. The interior wall panel 62A, however, needs to be installed during the process of assembling the posts and beams and exterior wall panel. Such installation should occur, for example, prior to the beam 52A being put in its final position. In contrast, with the embodiments of FIGS. 6 and 7B, the interior wall panels can be installed after the posts and beams and exterior wall panels are assembled in final position. It may be desirable to combine the feature of the groove 70A of the sill 61A of the embodiment of FIG. 8 with the embodiment of FIG. 6 by using a grooved sill 61A in the enbodiment of FIG. 6 rather than the sill 61 with the two-sided cutout 70. This would eliminate the need for the lower molding strip 62'.

It will be noted that the two-sided cutouts of the posts, beam and sill which receive peripheral portions of exterior wall panels as well as the recesses comprising two-sided cutouts or grooves which receive peripheral portions of interior wall panels have been illustrated with a common feature. That is, these cutouts and recesses extend fully along these posts, beams, and sill, allowing them to be simplified and thus less expensive than if this common feature were lacking. Additionally, the full-length cutouts and recesses of the inventive posts and beams render these parts especially suitable for manufacture by mass production.

While the invention has been described with respect to specific embodiments, modifications thereof will occur to those skilled in the art. For example, the horizontal beams which are parallel to an exterior of a post and beam building could comprise a sill for a higher building level or story. Further, the dowel used in the joint of the present invention could be replaced with a plurality of dowels. These and further such modifications are deemed to fall within the true spirit and scope of the appended claims.

What is claimed as my invention and desired to be secured by Letters Patent of the United States is:

1. An improved post and beam building comprising:
(a) a first post;
(b) a first beam parallel to an exterior wall of the building and resting on said first post;
(c) a second beam aligned with said first beam and resting on said first beam; and
(d) a third beam orthogonal to said first and second beams, resting on both said first post and said second beam, and laterally abutting portions of said first and second beams, the longitudinal section of said third beam resting on said first post having a cross section substantially undiminished from the cross section of the main portion of said beam.

2. The post and beam building of claim 1 further comprising:
(a) a rafter resting on said third beam, a portion of said rafter laterally abutting an end of said third beam; and
(b) a dowel inserted into aligned, vertical apertures of said first post, said first, second, and third beams, and said rafter.

3. The post and beam building of claim 1 wherein said first post and said first, second, and third beams each comprises timber.

4. The post and beam building of claim 1 wherein said second beam additionally rests on said first post, the longitudinal sections of said first and second beams resting on said first post having cross sections substantially undiminished from the cross sections of the respective main portions of said first and second beams.

5. The post and beam building of claim 1 further comprising a dowel inserted into aligned, vertical apertures of said first post and said first, second and third beams.

6. The post and beam building of claim 5 wherein said third beam rests on an upward projection of said first post, said upward projection laterally abutting said first and second beams.

7. The post and beam building of claim 5 further comprising a second post, a sill, and an exterior wall panel and wherein:
(a) said second post is adjacent said first post and supports said first beam;
(b) said first and second posts rest on said sill;
(c) adjacent, exterior edges of said first and second posts have two-sided cutouts therein, said cutouts rigidly receiving opposite side portions of said exterior wall panel; and
(d) a top portion of said exterior wall panel abuttingly overlaps a portion of said first beam, and a bottom portion of said exterior wall panel abuttingly overlaps a portion of said sill.

8. The Post and beam building of claim 7 further comprising an interior wall panel and wherein adjacent, interior edges of said first and second posts have recesses therein, said recesses respectively receiving side portions of said interior wall panel, said interior wall panel having a top portion abutting said first beam and a bottom portion abutting said sill.

9. The post and beam building of claim 8 wherein adjacent, interior edges of said sill and said first beam adjacent to said adjacent, interior edges of said first and second posts have recesses therein, said recesses respectively receiving said bottom portion of said top portion of said interior wall panel.

10. The post and beam building of claim 8 wherein said recesses comprise two-sided cutouts.

11. The post and beam building of claim 8 wherein said recesses comprise one of the group consisting of two-sided cutouts and grooves.

12. The post and beam building of claim 11 further comprising first and second facades having U-shaped cross sections and being respectively affixed to said first and second posts, each facade covering the interfaces between the respective post and interior wall panels abutting said respective post on the right side and on the left side thereof, respectively.

13. An improved post and beam building comprising:
(a) first and second posts spaced apart from each other;
(b) a first beam parallel to an exterior wall of the building and resting on said first and second posts;

(c) a second beam aligned with said first beam and resting on said first beam;

(d) a third beam orthogonal to said first and second beams and resting on both said first post and said second beam, the longitudinal section of said third beam resting on said first post having a cross section substantially undiminished from the cross section of the main portion of said beam;

(e) an exterior wall panel; and (f) a sill;

(g) said first and second posts resting on said sill;

(h) adjacent, exterior edges of said first and second posts having two-sided cutouts therein, said cutouts rigidly receiving opposite side portions of said exterior wall panel; and (i) a top portion of said exterior wall panel abuttingly overlapping a portion of said first beam, and a bottom portion of said exterior wall panel abuttingly overlapping a portion of said sill.

14. The post and beam building of claim 7 or 13 wherein an exterior edge of said sill adjacent to said adjacent, exterior edges of said first and second posts and said first beam has a two-sided cutout therein, said cutout rigidly receiving said bottom portion of said exterior wall panel.

15. The post and beam building of claim 7 or 13 wherein said exterior wall panel comprises one of the group consisting of a unitary piece of plywood and a unitary piece of particle board.

16. The post and beam building of claim 7 or 13 wherein an exterior edge of said first beam adjacent to said adjacent, exterior edges of said first and second posts has a two-sided cutout therein, said cutout rigidly receiving said top portion of said exterior wall panel.

17. The post and beam building of claim 16 wherein said exterior wall panel comprises one of the group consisting of a unitary piece of plywood and a unitary piece of particle board.

* * * * *